US006402307B1

(12) United States Patent
Wong et al.

(10) Patent No.: US 6,402,307 B1
(45) Date of Patent: Jun. 11, 2002

(54) INK JET CARTRIDGE HAVING INK DISPENSING AND STORING MATERIALS

(75) Inventors: Chyn Yeong Wong; Chung Mun Wong, both of Jurong Town (SG)

(73) Assignee: Fullmark PTE Ltd., Jurong Town (SG)

( * ) Notice: Subject to any disclaimer, the term of this patent is extended or adjusted under 35 U.S.C. 154(b) by 0 days.

(21) Appl. No.: 08/366,988

(22) Filed: Dec. 30, 1994

(30) Foreign Application Priority Data

Nov. 11, 1994 (EP) ..... 94117871

(51) Int. Cl.[7] ..... B41J 2/175
(52) U.S. Cl. ..... 347/86
(58) Field of Search ..... 347/87, 86, 85

(56) References Cited

U.S. PATENT DOCUMENTS 5,156,472 A * 10/1992 Suzuki et al. ..... 347/86
5,182,581 A * 1/1993 Kashimura et al. ..... 347/87
5,233,369 A * 8/1993 Carlotta et al. ..... 347/87

FOREIGN PATENT DOCUMENTS

| | | | |
|---|---|---|---|
| EP | 488829 | 6/1992 | |
| EP | 520695 | * 12/1992 | ..... 347/86 |
| EP | 536980 | 4/1993 | |
| EP | 577439 | 1/1994 | |
| EP | 581531 | 2/1994 | |
| FR | 2229320 | * 12/1974 | |

* cited by examiner

*Primary Examiner*—Judy Nguyen
(74) *Attorney, Agent, or Firm*—Ladas & Parry

(57) ABSTRACT

The present invention relates to an ink jet cartridge, in particular for supplying ink to an ink jet head of a recording apparatus, such as a printer or the like, said cartridge being characterised in that it contains at least two vacuum producing materials of different vacuum producing capacities while the higher density cellular material serves to meter the flow of ink there is another lower density cellular material disposed upstream of the denser material to provide a sufficient ink storage capacity.

7 Claims, 4 Drawing Sheets

INK JET CARTRIDGE HAVING INK DISPENSING AND STORING MATERIALS

Figure 1:
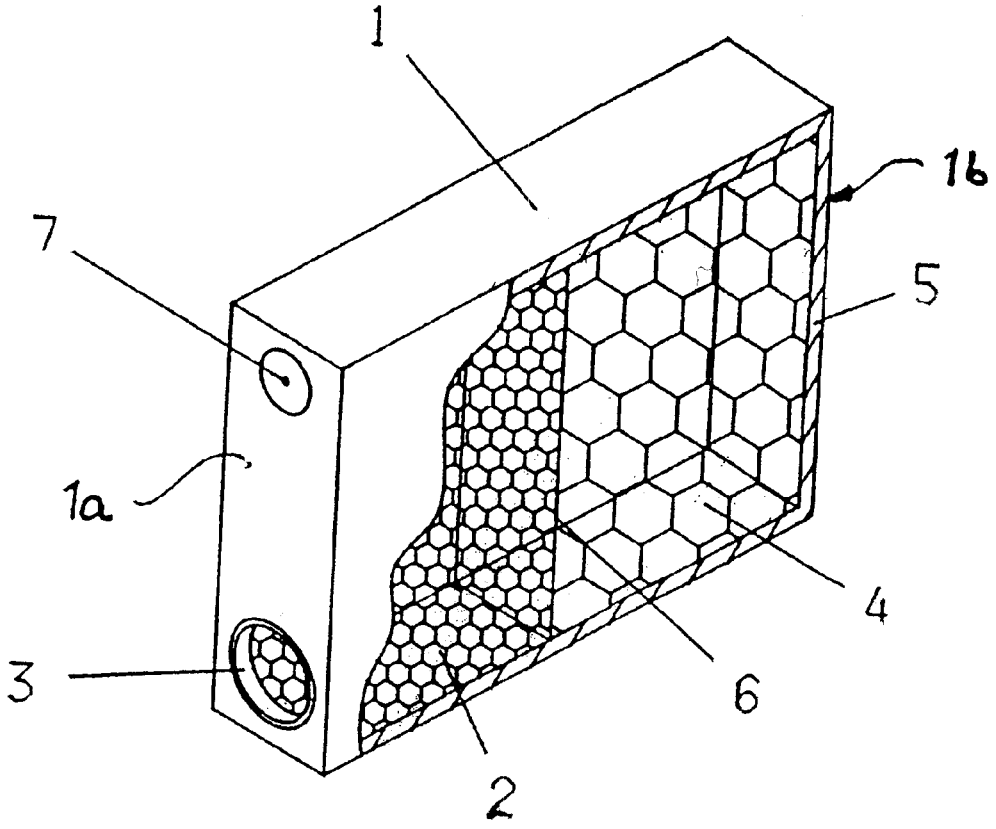

The present invention relates to an ink jet cartridge, in particular for supplying ink to an ink jet head of a recording apparatus, comprising a vacuum producing material inside a cartridge body which is provided with a communication opening for discharging the ink from the vacuum producing material and with a venting hole for balancing the pressure inside and outside of the jet cartridge body.

Ink cartridges are used in ink jet applications for computer printers, plotters, copying machines, facsimile machines or any other related recording apparatus and office equipment. During the application, the ink cartridge is fixed to the printing machine and is connected to the print head unit of the machine. The ink cartridge, thus, supplying ink to the print head to enable the machine to print characters or images. The ink cartridge body forms as container for storing the ink. The ink is held in the container by means of a vacuum producing material such as foam or foam pads of synthetic resin, respectively occupying the internal space of the cartridge body either partially or entirely. When the ink in the cartridge has been consumed the cartridge will be disposed of. The useful life of the cartridge is determined by the amount of ink that can be stored into the cartridge before use and the ink remaining in the cartridge as being held by the foam material after use. The ability to hold and retain ink in the cartridge, thus, substantially depends on the porousity or density of the foam material, which simultaneously, has the function of metering the ink to control the flow rate of the ink entering into the print head unit of the printing machine. In order to prolongate the life time of a cartridge it is the aim to store as much ink as possible in the cartridge and to minimise the the amount of ink retained in the cartridge, which can no longer be discharged towards the printing head due to the material-imminent and unavoidable remainder storage capacity of the foam.

Conventional ink cartridges use a single density foam pad to serve both ink storage and appropriate control of the ink flow rate. In order to assure a good metering of the ink flow the use of higher density foam is advisable. However, in such a case the ability of the foam pad to store greater amounts of ink is affected as the interior space of the cartridge body is completely occupied by the high density foam which is undesirable from the viewpoint of providing a high ink storage capacity. Moreover, high density foam retains more ink and, therefore, the quantity of non-useable ink is relatively high. Accordingly, the efficiency of ink useage in case of such a cartridge is low and further shortens the useful printing life of the cartridge.

Other conventional high capacity ink cartridges do not use any foam pads to hold the ink inside the cartridge body. In such cases the whole container body, thus, is filled with ink only. However, complicated air pressure balancing elements have to be integrated in order to be able to control the flow rate of the ink. An example of such a system uses a flat spring loaded airbag pressure control system. These pressure control systems are complicated and add to the costs of such a cartridge. Moreover, mass production is difficult.

From GB-A-2 268 910 an ink supply system for jet printers is known having an ink supply cartridge, which comprises two chambers which are interconnected by a narrow passage with one of the chambers being vented to the atmosphere at a point above the interconnecting passage and contains a capillary material which will withdraw ink into itself while the other chamber does not have any capillary filling. While such a system combines some advantages in view of the metering capabilities of a foam-filled cartridge body with those of a high ink storage capacity using a ink storage chamber without any foam material therein, also with such a system the manufacturing costs increase and difficulties in an undesirable leakage of the ink may occur.

Accordingly, it is an objective of the present invention to improve an ink jet cartridge as mentioned above in that it should combine high ink storage capabilites with a reliable preventing of leakage of ink and optimal ink metering capabilities by controlling the ink flow rate appropriately. Moreover, by increasing the difference between the big amount of ink storable at the beginning of print and the retained minimum amount of ink at the end of operation, a long print life and efficient useage of the ink should be assured through the ink jet cartridge.

In order to perform the aforeindicated objectives the present invention improves the ink jet cartridge in that the jet cartridge body accommodates at least two vacuum producing materials of different vacuum producing capacities.

According to a preferred embodiment the internal space of the jet cartridge body comprises two porous materials in contact to each other, said materials having different ink storage capabilities with the material having a higher vacuum producing capacity being disposed closer to the communication opening than the other vacuum producing material having a lower vacuum producing capacity. A communication opening is adapted to transfer the ink from the internal space of the cartridge body to the printing head.

According to yet another preferred embodiment of the present invention the vacuum producing materials are foams or foam pads of higher and lower foam densities, respectively.

In a preferred design of the ink jet cartridge according to the present invention the two foam pads of different foam densities are disposed side by side in the internal space of the cartridge body with the high density foam pad being in close proximity to the communication opening.

According to yet another preferred embodiment of the present invention, the two foam pads of different foam densities are disposed to contact each other, preferrably along a plane which extends in parallel to at least one wall of the cartridge body.

Thus, by means of filling the continuous interior space of the cartridge body with at least two vacuum producing materials of different vacuum producing capacities, preferrably by introducing a foam pad of high foam density in one part of the cartridge body adjacent to the communication opening, while the rest of the cartridge body is filled with a foam pad, of low foam density both a high ink storage capacity through the lower density foam pad and a high dispensing (i.e. metering quality and ink flow rate) control by means of the high density foam pad, which is disposed downstream of the low density foam pad, are achieved.

Thus, the ink cartridge has a cartridge body accommodating two different density foams or foam pads for the storage of the ink. The high density foam pad is used for metering the ink flow rate and for preventing leakage. The lower density foam pad is provided for storing a big amount of ink and for releasing the ink towards the high density foam pad easily. With the combination of both foam pads which are in contact to each other the ink jet cartridge assures a high amount of ink to be storable by the lower density foam pad and at the same time assures prevention of leakage as well as the ability to control the ink flow rate by the higher density foam pad. Thus, the cartridge can hold a big amount of ink at the beginning of the print and retain only a minimum amount of ink at the end of the use.

Accordingly, the ink storage system, ie. the ink jet cartridge of the present invention comprises of at least two different vacuum producing materials having different vacuum producing capacities, specifically comprises two different foam pads of different foam densities in the cartridge body. The higher density foam is located nearer to the communication opening that is connected to the print head unit upon fixing the cartridge to a printing machine.

The purpose of the higher density foam is to control the ink flow rate to the print head unit and to create higher vacuum pressure to prevent ink from leaking through the communication opening hole. Moreover, all opening holes are properly sealed for transportation purposes to further eliminate any ink leakage. The sealing materials are detachable before using the cartridge.

The second foam pad with lower foam density is capable of holding a big amount of ink and to release ink to the first higher density foam pad downstream of the second lower density foam pad easily. The lower density foam is located distant from the communication opening hole with the first higher density foam being disposed between said communication opening hole and the second lower density foam pad.

Due to its lower density a second lower density foam pad is able to store a big amount of ink, but produces very little vacuum pressure to hold the ink. Therefore, all contact surfaces of the cartridge body that are in touch with the second lower density foam pad are fully sealed to eliminate the ink from leaking out of the cartridge body.

Preferrably only one surface of the lower densities sponge is in contact with the first higher density foam pad to enable the lower density sponge to supply ink to the first higher density foam.

The density and size of the first higher density foam pad is adapted to the specific operational needs the ink jet cartridge aims to meet for a proper control of the ink flow.

Preferrably the thickness of the first higher density foam pad is bigger than the internal width of the cartridge body, so as to create a tight contact through its sponge effect to the cartridge wall upon inserting the foam pad into the cartridge body. The tightness of the contact and the pressure towards at least two opposite walls of the cartridge bodies should ensure to hold the foam pad and to maintain its location upon inserting the cartridge body into a printing machine. This is to assist and ensure a proper contact of the higher density foam pad and the printing head unit in order to ensure a proper flow of ink.

Normally, an ink jet cartridge as indicated hereinabove is handled by an operator or office clerk and therefore it is always possible that strong forces are applied and deform the ink container wall causing the ink storing foam pads to be squeezed and to render the ink leaking out. Therefore, the thickness of the walls of the cartridge body must be properly designed taking the cartridge size as well as the type of plastic material for the cartridge body into consideration to gain sufficient rigidity of the cartridge.

Finally, it is preferred to provide lugs or internal projections, preferrably opposite ones raising from the inner walls of the cartridge body to establish additional abutting and holding means for the foam pads inside the cartridge body.

Further preferred embodiments of the present invention are laid down in the other subclaims.

Figure 2:
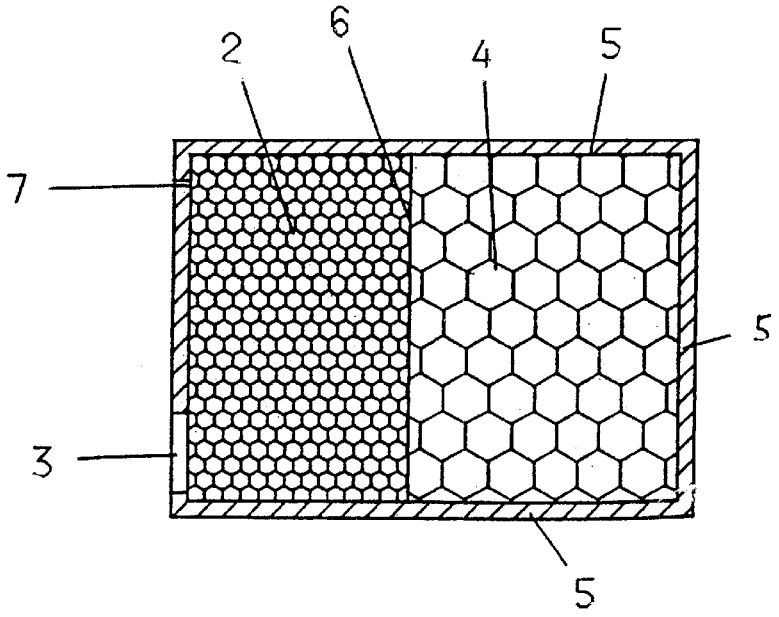
Figure 3:
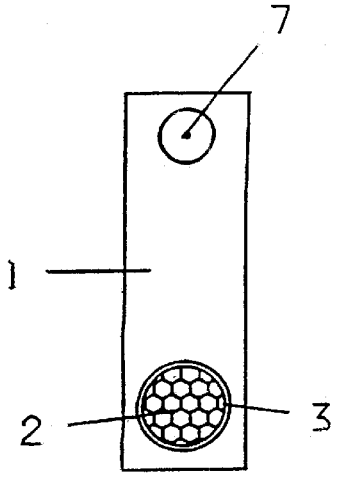
Figure 4A:
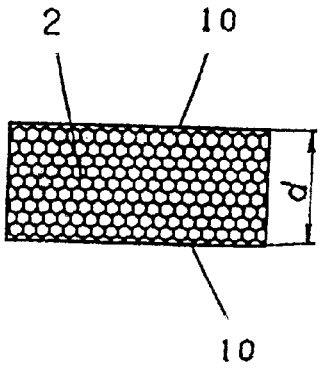
Figure 4B:
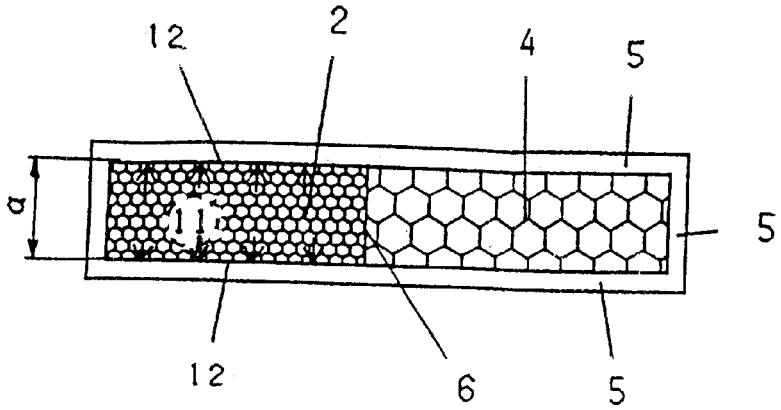
Figure 5:
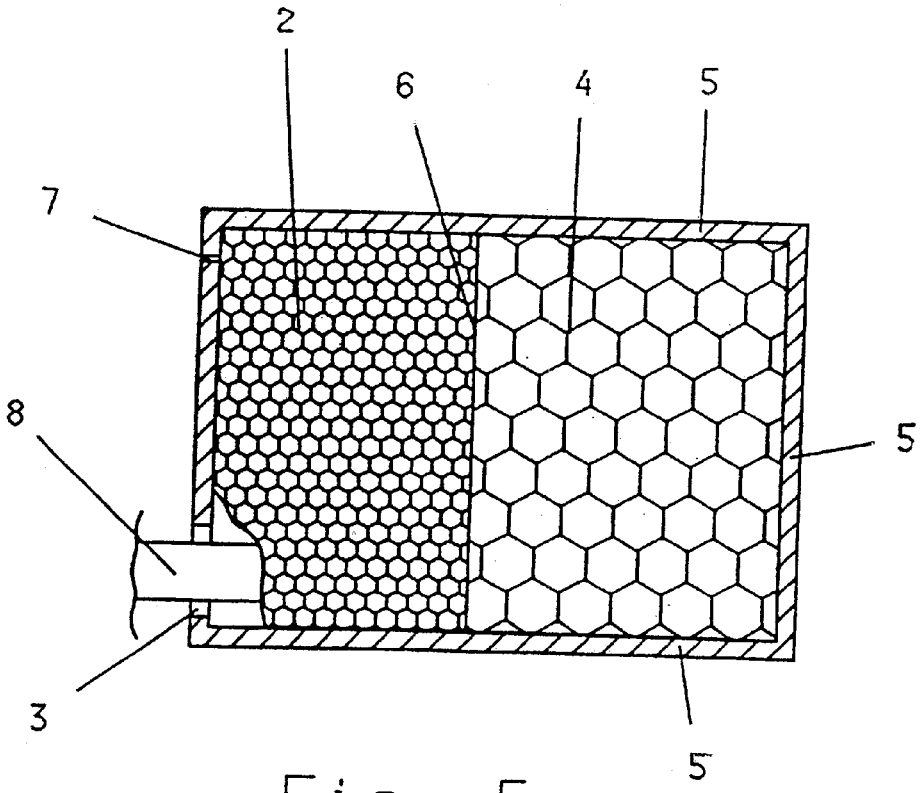
Figure 6:
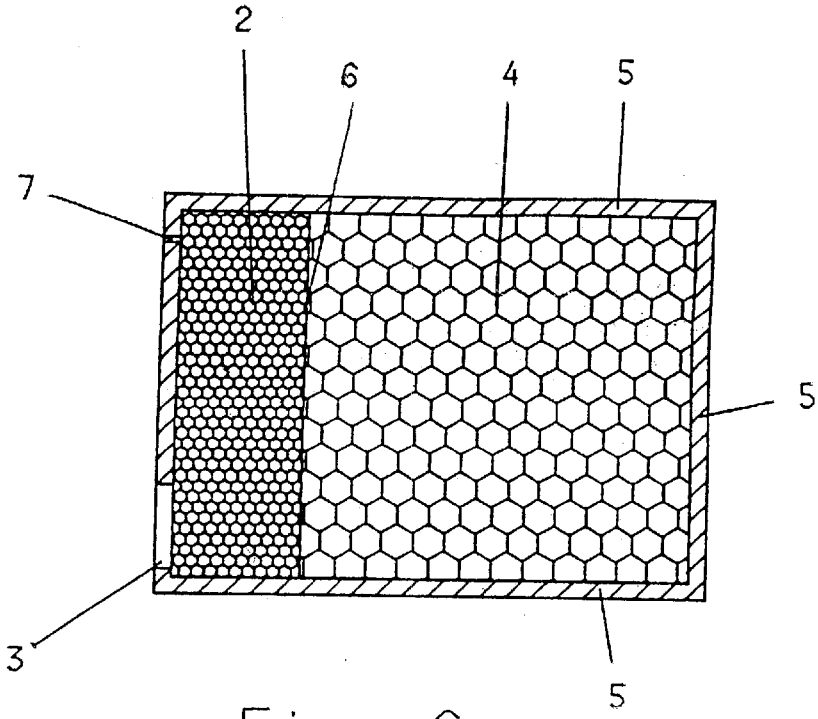
Figure 7:
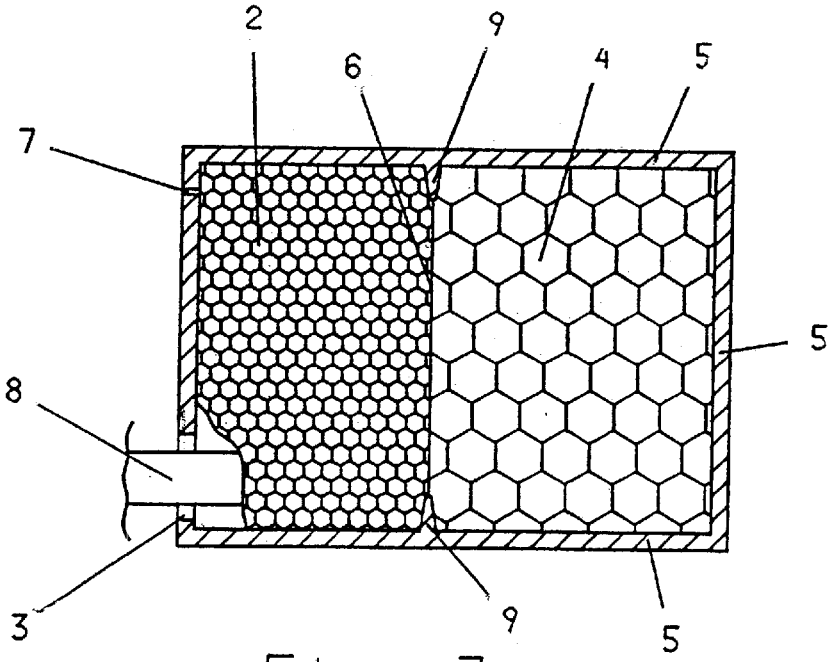

In the following preferred embodiments of the present invention is explained in greater detail by means of the accompanying drawings wherein:

FIG. 1, shows a schematic perspective view of an ink jet cartridge according to an embodiment, with one side wall partially broken away to show the internal structure of the cartridge, FIG. 2, illustrates a longitudinal view of the ink jet cartridge of FIG. 1, FIG. 3, shows a side view of the ink jet cartridge according to FIGS. 1 and 2, FIG. 4*a*, shows an elevational view of the high density foam pad, FIG. 4*b*, shows a schematic top view of the cartridge with the upper wall being removed, FIG. 5, shows a longitudinal sectional view similar to FIG. 2 with the cartridge being inserted onto a printing machine, FIG. 6, shows another embodiment of the ink jet cartridge of the present invention with different types of foam pads used in different dimensional ratios compared to the first embodiment, and, FIG. 7, shows a longitudinal cross section similar to FIG. 5 for a modified design of the cartridge body for fixing the foam pads in the interior thereof.

According to a first embodiment of the ink jet cartridge shown in FIGS. 1 to 5, same comprises of a substantially rectangularly shaped main body 1 (parallepiped) having an internal empty space to accommodate two foam pads 2, 4 in the one continuous interior space of the cartridge body 1. The foam pads 2, 4 are of different foam densities, ie., a higher density foam pad 2 is located at that side of the cartridge body 1 having a communication opening hole 3 to communicate the interior space of the cartridge body to a print head unit 8 (see FIG. 5). The higher density foam pad 2 having a higher vacuum producing capacities than a lower density foam pad 4 which is located away from the communication opening hole 3 and is separated therefrom by the higher density foam pad 2. The lower density foam pad 2 has a lower number of cells or porous structures per cubic centimeter and, therefore, releases ink with which it is impregnated easier than the high density foam pad 2.

The higher density foam pad 2 has the capability of metering the amount of ink flow from the low density foam pad 2 to the communication opening 3 due to its vacuum pressure producing effect or the high density foam material. The vacuum pressure produced by the material, a synthetic resin foam of a larger number of pores or cells per cubic centimeter retains the ink and controls the amount of ink release towards the communication opening hole 3.

The lower density foam pad 4, on the other hand, has a much lower number of pores and cells per cubic centimeter and, thus, has plenty of room to absorb ink and is very desirable to meet the aim of storing as much ink as possible. However, due to the larger pores of the material it is unable to create a high vacuum pressure. Therefore, ink will be released out of said low density foam pad very easily. This is also much desirable as very little amounts of ink will be retained in said low density foam pad 4, so that the effeciency and storage capacity of the lower density foam pad 4 is high, ie. the useable amount of ink stored by the lower density foam pad 4 is maximal as only a minimum amount of ink is retained at the end of operation and due to the high ink release efficiency the overall useful printing life of the cartridge is extended.

Thus, the second lower density foam pad 4 is able to hold a big amount of ink but produces very little vacuum pressure to hold the ink and, therefore, releases the ink to the first higher density foam pad 2 easily. Said first higher density foam pad 2 then meters the flow of ink to the printer head and supplies the ink through the communication opening hole 3.

As is derivable from FIGS. 1 to 5 the two foam pads 2, 4 contact each other with their contact surfaces along a contact plane 6, which extends in parallel to the smaller front and rear sides 1*a*, 1*b* of the cartridge body 1. As shown in FIGS. 1 and 3, the small front side 1*a*, close to its bottom portion, comprises the communication opening 3 in contact with the higher density foam pad 2 receiving the ink from the second lower density foam pad 4 from which the ink is easily released and migrates into the higher density foam pad 2. In the area of the second lower density foam pad 4 the ink cartridge 1 is fully sealed by the circumference walls 5 of the cartridge body 1 to prevent ink from leaking out. The only remaining contact surface of the lower density foam pad 4 extending in the contact plane 6 is in close contact with the higher density foam pad 2. As a result the ink will be migrating to the higher density foam pad 2 throughout the entire contact surface in plane 6 when the full amount of ink according to the ink storage capability of the lower density foam pad 2 is achieved.

An air venting hole 7 is provided at the same side of the cartridge body 1 as the communication opening hole 3, ie. the vent opening hole 7 penetrates the smaller front wall 1*a*.

The location of the air vent hole 7 is selected such that it is furthest from the lower density foam pad 4 to reduce practically the chances of any ink leakage from the cartridge body 1. Without an air venting hole the increasing vacuum pressure would soon cause print problems due to an insufficient supply of ink to the printing head. With air venting hole 7, the air is able to enter into the interior of the cartridge body 1 preventing the vacuum pressure to become excessively high for the ink jet cartridge to work properly.

FIG. 4*a* shows an elevational top view of the high density foam pad 2 with its opposite bigger side faces 10.

While in any case the higher density foam pad 2 provides higher vacuum producing capacity than the lower density foam pad 4, the ratio between said capacities determining the flow rate of the ink to suit to the respective ink jet printer, the density and size of the first higher density foam pad 2 is adapted to the specific needs of the printing head and the type of the printer used, thus specifically the first higher density roam pad 2 is carefully selected and tested for a proper control of the ink flow.

In the non-inbuilt condition the width d of the higher density foam pad 2 exceeds the distance a between the inner surfaces 12 of the opposite walls S of the cartridge body 1. Accordingly, as the thickness of the higher density foam head 2 is bigger than said internal width a of the cartridge body 1 a tight contact between the higher density foam pad 2 and the cartridge body 1 is assured through the sponge effect of the foam pad 2 creating an outward pressure towards the inner surfaces 12 of the walls 5 of the cartridge body 1, thus generating additional pressure force to hold the foam pad the fixed location after it has been inbuilt into the cartridge body 1 as shown in FIG. 4*b*. Accordingly, the higher density foam pad 2 is dimensioned and selected in size and hardness to be able to squeeze when put into the cartridge body 1 and to create said outwards pressure force, which is indicated by little opposite arrows 11 in FIG. 4*b*. The tightness of this contact should be able to hold the foam pad 2 and maintain its location upon inserting the ink jet cartridge into the printing machine. This is to ensure a proper contact of the foam pad 2 and the print head unit in order to ensure a proper flow of ink. More specifically, the pressing force symbolised by the arrows 11 in FIG. 4*b* should be high enough to hold the higher density foam pad 2 at its position and to withstand to a certain extend vibrations and locking forces. Moreover, the foam pad 2 should maintain its overall position upon fixing the ink jet cartridge onto the printing machine, so as to maintain a good contact between the higher density foam pad 2 and a printing head unit 8 as examplified in FIG. 5. By the way, a proper selection for the higher density foam pad 2 material assures that the size ratio between the higher density foam pad 2 and the lower density foam pad 4 should be in the range from 1:1 to 1:3. A too small sized high density foam pad 2 would create insufficient vacuum pressure and ink leakage while a too large sized higher density foam pad 2 leaves too little room for the ink to be put in and leads to an undesirable high amount of ink retained therein shortening the useful printing life of the cartridge. Such a size selection is shown in FIG. 6 exemplifying one embodiment wherein the size ratio between the high density foam pad 2 and the low density foam pad 4 is in the area of 1:3.

According to another embodiment of the present invention, in order to further improve the reliable location of the two foam pads 2, 4 within the cartridge body 1 it is possible to add one or two opposite dams of lugs 9 as shown in FIG. 7, said dams or lugs are intersected by the contact plane 6 between the two foam pads 2, 4. The dams or lugs 9 act as stopper portions to fix the location of the higher density foam pad 2 while at the same time still allowing the overwhelming part of the two contact surfaces of the foam pads 2, 4 to be in close contact to enable the migration of the ink from the lower density foam pad 4 to the higher density foam pad 2.

Sometimes strong forces may be applied to the ink jet cartridge and deform the cartridge body 1, specifically the walls 5 which might cause the ink to be squeezed and leaking out. Therefore, the thickness of the walls 5 including those of the opposite smaller side walls 1*a*, 1*b* must be designed under consideration of the cartridge size as well as under consideration of the type of synthetic resin material used to gain sufficient rigidity.

In other modifications of the ink jet cartridge of the present invention it would also be possible to insert for example, three different types of foam pads ie, foams of different densities or to leave a smaller part of the cartridge upstream of the lower density foam pad empty to store in an amount of ink therein, which impregnates the lower density foam pad 2 which then, in turn allows the ink to migrate into the ink flow metering higher density foam pad 2 in contact with the communication opening of the ink jet cartridge.

What is claimed is:

1. An ink cartridge comprising first and second vacuum producing materials respectively having first and second vacuum producing capacities respectively for dispensing and storing ink, the first and second materials being in surface-to-surface contact with each other enclosed inside a cartridge body, the cartridge body having a communication opening through one side of the cartridge body that is in communication with the first material for discharging the ink from the first material and the cartridge body and a venting hole in the one side of the cartridge body for balancing pressure inside and outside of the cartridge body, wherein walls of the cartridge body around the second material are fully sealed.

2. An ink cartridge comprising a cartridge body, first and second vacuum producing materials inside the cartridge body and respectively having first and second vacuum producing capacities respectively for dispensing and storing ink, the first and second materials each having one side only in surface-to-surface contact with each other, the cartridge body having a communication opening through one side of the cartridge body that is in communication with an opposite side of the first material from the one side of the first material for discharging the ink from the first material and the cartridge body and a venting hole for balancing pressure inside and outside of the cartridge body, the surface-to-surface contact of the first and second materials extending over all of only the one side of the first material, the one side of the first material being parallel to an inside surface of the one side of the cartridge body and the first material having a uniform thickness in a direction from the one side of the first material to the opposite side of the first material that is in communication with the communication opening, wherein walls of the cartridge body around the second material are fully sealed.

3. An ink cartridge comprising a cartridge body, first and second vacuum producing materials inside the cartridge body and respectively having first and second vacuum producing capacities respectively for dispensing and storing ink, the first and second materials each having one side only in surface-to-surface contact with each other, the cartridge body having a communication opening through one side of the cartridge body that is in communication with an opposite side of the first material from the one side of the first material for discharging the ink from the first material and the cartridge body and a venting hole for balancing pressure inside and outside of the cartridge body, the surface-to-surface contact of the first and second materials extending over all of only the one side of the first material, the one side of the first material being parallel to an inside surface of the one side of the cartridge body and the first material having a uniform thickness in a direction from the one side of the first material to the opposite side of the first material that is in communication with the communication opening, wherein the venting hole is in the one side of the cartridge body, and wherein walls of the cartridge body around the second material are fully sealed.

4. An ink cartridge comprising a cartridge body, first and second vacuum producing materials inside the cartridge body and respectively having first and second vacuum producing capacities respectively for dispensing and storing ink, the first and second materials each having one side only in surface-to-surface contact with each other, the cartridge body having a communication opening through one side of the cartridge body that is in communication with an opposite side of the first material from the one side of the first material for discharging the ink from the first material and the cartridge body and a venting hole for balancing pressure inside and outside of the cartridge body, the surface-to-surface contact of the first and second materials extending over all of only the one side of the first material, the one side of the first material being parallel to an inside surface of the one side of the cartridge body and the first material having a uniform thickness in a direction from the one side of the first material to the opposite side of the first material that is in communication with the communication opening, wherein the first and second materials are foams of higher and lower density, and wherein walls of the cartridge body around the second material are fully sealed.

5. The ink cartridge as claimed in claim 4, wherein initial outer dimensions of the first material exceed inner dimensions of an accommodating space for the first material in the cartridge body only sufficiently for outwards holding pressure against the cartridge body.

6. The ink cartridge as claimed in claim 5, and further comprising dams projecting from opposite side surface of the cartridge body that intersect opposite sides of the surface-to-surface contact between the first and second materials.

7. The ink cartridge as claim 6, wherein a ratio of the thickness of the first material in the direction to a thickness of the second material in the direction is in a range of from 1:1 to 1:3.

* * * * *